United States Patent [19]

Nagler et al.

[11] Patent Number: 4,646,642

[45] Date of Patent: Mar. 3, 1987

[54] SEPARATING ARRANGEMENT INCLUDING AN EXPANSION CHAMBER FOR A PYROTECHNIC CHARGE

[75] Inventors: Josef Nagler, Nuremberg; Utz-Udo Ahlers, Schnaittach, both of Fed. Rep. of Germany

[73] Assignee: Diehl GmbH & Co., Fed. Rep. of Germany

[21] Appl. No.: 707,643

[22] Filed: Mar. 4, 1985

[30] Foreign Application Priority Data

Mar. 16, 1984 [DE] Fed. Rep. of Germany ..... 3409714

[51] Int. Cl.[4] ..... F42B 15/10

[52] U.S. Cl. ..... 102/378; 102/293; 102/340; 89/1.14

[58] Field of Search ..... 102/377, 378, 293, 340, 102/342, 351, 354, 357, 374; 52/98; 60/225; 285/3, 4; 89/1.14

[56] References Cited

U.S. PATENT DOCUMENTS

| | | | |
|---|---|---|---|
| 3,108,540 | 10/1963 | Fletcher | 102/378 |
| 3,196,745 | 7/1965 | Sustrich et al. | 89/1.14 |
| 3,633,509 | 1/1972 | Grandy et al. | 102/338 |
| 4,080,900 | 3/1978 | Augenstein et al. | 102/495 |
| 4,499,829 | 2/1985 | Jacobson et al. | 102/293 |

*Primary Examiner*—Stephen C. Bentley
*Assistant Examiner*—Ted L. Parr
*Attorney, Agent, or Firm*—Scully, Scott, Murphy & Presser

[57] ABSTRACT

A separating arrangement between multipart constructional elements, including an expansion chamber for at least one pyrotechnic charge which is bounded by the piston surface of a displacement or sliding piston. The separating arrangement has at least one gas passageway which communicates with the expansion chamber, through the intermediary of which a separating piston can be subjected to pressure. The combustion gas pressure of the pyrotechnic charges acts within the expansion chamber against different piston surfaces and thereby, in a constructively predeterminable manner, effects different successive piston movements, as a result of which the sequence of the individual separating operations which can be carried out in different directions predeterminably in a definite manner and functionally-dependent.

10 Claims, 1 Drawing Figure

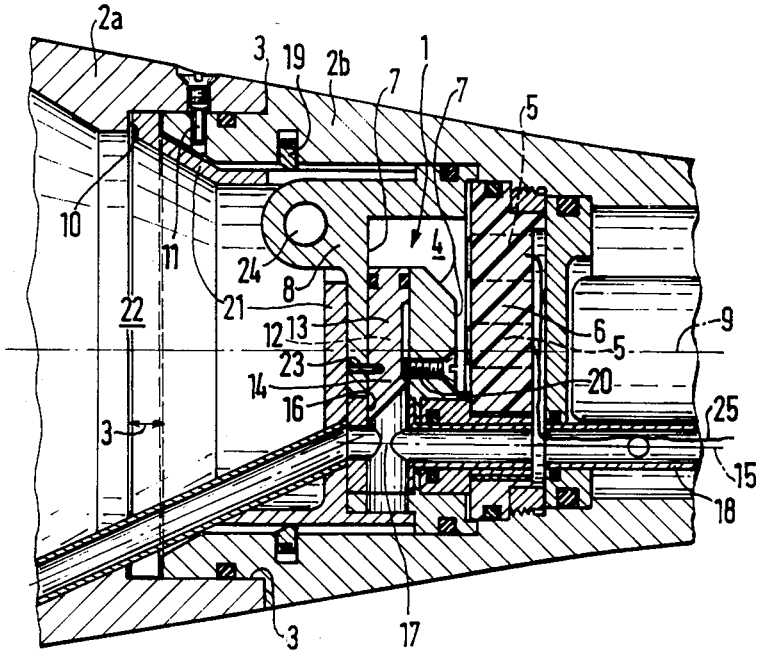
2a
3
19
2b
1
7
7
5
10
11
24
4
8
21
22
12
13
6
5
9
23
20
14
16
25
3
15
18
3
17

SEPARATING ARRANGEMENT INCLUDING AN EXPANSION CHAMBER FOR A PYROTECHNIC CHARGE

BACKGROUND OF THE INVENTION

1. Field of the Invention

The present invention relates to a separating arrangement between multipart constructional elements, including an expansion chamber for at least one pyrotechnic charge which is bounded by the piston surface of a displacement or sliding piston.

2. Discussion of the Prior Art

An arrangement of that type, which is used as a safety device, has become known from the disclosure of European Laid-Open Patent Specification 88 247; in effect, for the separation of certain constructional elements from each other upon the occurrence of special operating conditions. The invention; however, in particular relates to a separating arrangement for a multipart constructional element which is in the shape of the axially-divided shell of a test missile, of the kind as is illustrated in the upper picture on page 22 of the article by Peter J. George "Endphasenlenkung—Revolution der Artillerie?", WEHRTECHNIK, Volume 3/1979, pages 19 through 27. A test projectile of this type should not shatter after completing its mission, but should release recovery or salvage parachutes.

Because of its size and its equipment, the projectile-shaped test missile, on the other hand, can only be poorly landed in a soft state when it is in its entirety. Consequently, the casing construction is divided into a number of parts for the recovery thereof, in order that these will land softly independently of each other due to possessing their own recovery parachutes; wherein provisions can be made previously, that only reuseable parts, in essence, the parts of the missile which are to be salvaged for experimented evaluation are to be equipped with recovery parachutes.

However, problems can be encountered in the separation of the individual constructional elements through pyrotechnic energy development in the salvage of the mutually separated parts of the missile, in that conduits or connectors bridge or extend over the predetermined separating locations.

Such conduits or connectors, under circumstances; for example, based on reasons of the operational dependability of the installations in the not yet separated missile, may not simply be closely-fitted plugged together for bridging over the separating location; or because of other reasons such conduits can adversely influence a defined separating procedure; for instance, inasmuch as due to their elasticity they can still maintain an undesired coupling of the constructional elements of the missile construction which have been already mechanically lifted apart from each other.

SUMMARY OF THE INVENTION

In recognition of these difficulties, which is caused by the mounting of complex systems within a separable missile of the above-mentioned type, it is an object of the present invention to so design a separating arrangement of the above-mentioned type, so as not to only afford the defined mechanical separating displacement of the constructional element relative to each other on both sides of the separating location, but to also ensure additional separating procedures with the same operational dependability, without the additional requirements for special voluminous or operationally additional measures.

The foregoing object is inventively attained through a separating arrangement in conformance with the present construction in that at least one gas passageway communicates with the expansion chamber, through the intermediary of which a separating piston can be subjected to pressure.

Pursuant to the foregoing object, the combustion gas pressure of the pyrotechnic charges acts within the expansion chamber against different piston surfaces and thereby, in a constructively predeterminable manner, effects different successive piston movements, as a result of which the sequence of the individual separating operations which can be carried out in different directions predeterminably in a definite manner and functionally-dependent.

In particular, the inventive measure provides the possibility that for pistons of extremely different diameters, the smaller piston or pistons may themselves be arranged on or in the larger piston, and thereby the further separating locations can be arranged closely adjacent each other. This, in turn, also provides in particular freely variable constructive possibilities for the predetermination of the forces for the piston movements, and different shearing forces for the initiation and completion of the separating operations; whereby the directions of movement of the individual pistons deviate from each other and, in particular, can also be oriented transverse to each other. Thus, transverse relative to and within a larger piston there can be guided a smaller piston which, for example, can be constructed at one end thereof directly as a separating cutter for conduits or connectors which, in the direction of the separating movement between the constructional elements, and thereby in the direction of action of the larger piston, extend between the elements of the missile construction and have to be separated, prior to these elements raising away from each other along the separating location.

BRIEF DESCRIPTION OF THE DRAWING

Additional alternatives and modifications, as well as further features and advantages of the invention may be readily ascertained from the following detailed description thereof taken in conjunction with the drawing illustrating an essentially simplified but approximately true scaled preferred embodiment.

The single FIGURE of the drawing illustrates, in a fragmentary axial longitudinal sectional view, a two-part carrier missile constituted essentially of tubular shell elements; shown in the region of its separating location between mutually detachable constructional elements prior to initiation of force or energy elements in the form of pyrotechnic charges in the separating arrangement.

DETAILED DESCRIPTION

The two tubular constructional elements 2*a*, 2*b* of a carrier missile, which interengage at their end surfaces in the region of a separating arrangement 1, should through axial displacement from each other, separate the missile into two parts along a separating location 3, each of which part represents an independent functional component which is to be recovered. For this purpose, proximate the separating location 3, there is formed an expansion chamber 4 within the smaller carrier missile tube element 2b. The chamber is in communication with at least one pyrotechnic charge 5 which, for instance, is inserted into a holder 6 fastened to this missile element 2b. Oppositely located, the expansion chamber 4 is bounded by the piston surface 7 of a displacement or sliding piston 8 which acts in the longitudinal direction of the elements 2a and 2b. This piston is displaceable in parallel with the longitudinal axis 9 of the carrier missile relative to the element 2b, and is guided therein, up to against a stop 19, when the pressure of the combustion gas builds up in the expansion chamber 4, since through electrical connectors 25 (for example, by means of a launching distance control or remotely controlled) there are ignited the charges 5.

Oppositely located, in effect, towards the constructional element 2a of the heavier portion of the carrier missile construction, the displacement piston 8 is supported through the intermediary of a hollow ram 21 conically widening towards the former, against a shoulder 10 on the element 2a of the carrier contacting at that location. Upon the development of pressure in the expansion chamber 4, as a result thereof the lighter portion of the carrier with the element 2b, is raised away from the element 2b opposite the supporting direction on the shoulder 10, along the separating location 3; as soon as the shear pins 11 have ruptured, by means of which the carrier constructional elements 2a, 2b had been interconnected during the function of the unseparated carrier missile construction.

In the expansion chamber 4 which is bounded by the large piston surface 7, there communicates a gas passageway 12 of contrastingly smaller cross-section, which is formed in the displacement piston 8. Slidably supported within the gas passageway 12 is a separating piston 13 which is correspondingly smaller relative to the piston surface of the displacement piston 8, which is thus concurrently subjected to by the same combustion pressure of the charges 5, as is the large displacement piston 8. The forward movement of the separating piston 13 in or in front of its gas passageway 12, due to the correspondingly thinner dimensioning of its shear pin 23 (with consideration to the constructively predeterminable energy relationships by the effective piston surfaces on the pistons 8/13) is initiated earlier than that of the forward movement of the displacement piston 8 after the rupture of the correspondingly heavier dimensioned shear pins 11. Consequently, by means of the separating piston 13 there can be carried out operations, which should be initiated earlier due to constructive reasons than the raising off of the two carrier constructional elements 2a, 2b from each other along their separating location 3. The implementation of the gas passageway 12, with the support of the separating piston 13 within the larger displacement piston 8, not only facilitates a compactly-constructed separating arrangement 1, but also one which is oriented in different effective directions, in the example shown in the drawing, transversely converging directions of effect of the displacement piston 8 and of the separating piston 13 directly adjacent each other.

Preferably, the separating piston 13 serves for the cutting apart of mechanical connections between the constructional elements 2a, 2b which are to be separated. For this purpose, the separating piston 13 is in operative connection with a cutter 14. The latter can be directly constructed at that end of the separating piston 13 which does not face towards the gas passageway 12 or, in essence, the expansion chamber 4. For the defined shearing of conduits 15 (for instance, tubular conduits, connecting cables or electrical cables) extending between the carrier constructional elements 2a, 2b, the cutter 14 displaces itself, prior to the raising away of these elements 2a/2b from each other, along a guide wall 16 through which there extend the conduits 15, up to contacting against a guide and stop pin 20. Purposefully, the conduits 15 are guided on both sides of the cutting location 17 within a tube 18 which is interrupted in the immediate proximity of the cutting location 17, which allows for the rapid implementation of a clearly defined separating cut. Thereafter, there is not present any hindering connection of conduits 15 between the elements 2a and 2b. A further pressure rise in the expansion chamber 4 leads then to the rupturing of the shear pins 11, which have held together until the present, and thereby to the undisturbed raising away of the lighter element 2a along the separating location 3. Hereby this element 2b displaces itself relative to the displacement piston 8 which is supported on the shoulder 10 against the element 2a, until the piston contacts against the stop 19 fixed on its raised away element 2b. The applicable extent of displacement is so measured with respect to the interengagement of the elements 2a, 2b at the separating location 3, that the elements 2a and 2b are then already disengaged, in effect, raised away from each other. However, hereby the displacement piston 8, in conjunction with the separating piston 13 which is built in and the shearing ram 21 which is fastened thereto, in conjunction fitted and attached to the raised away element 2b which is equipped with the separating arrangement 1.

For the recovery or salvage of the separated elements 2a, 2b of the carrier missile construction by means of parachute, there is formed in the end of the element 2a adjacent the separating location 3, a parachute storage space 22, which extends into the adjoining connecting area of the element 2b; in essence, at that location into the funnel-shaped opening shearing ram 21, beyond the plane of the separating location 3. Projecting into this storage space 22 is a protuberance of the displacement piston 8 lying against the ram 21, on which there is formed an eyelet 24 for shroud lines for effecting the pulling out of the parachutes (not shown in the drawing) when the separated elements 2a, 2b move away from each other. Inasmuch as upon the initiation of the separating sequence the funnel shaped ram 21 will be load-transmissively positioned against the shoulder 10, initially no displacement movement takes place between the wall portions of the storage space 22 and the recovery parachutes arranged therein, so that the latter are protected from any damage caused by rubbing movements. Only first when the displacement piston 8 lies against its contact 19 on the raised element 2b, and the engagement with the adjoining element 2a has also already been terminated, then the funnel-shaped ram 21 is also raised away from the element 2a, and the storage space 22 opens itself in the cross-sectional plane of the shoulder 10. As a result, the parachutes are drawn out, of which a few are fastened to the heavier carrier missile constructional element 2a (not shown in the drawing) and others, for instance by means of the eyelet 24, are fastened to the raised constructional element 2b, in order these elements, which during the test operation are interconnected by means of the shear pins 11, will independently and separately softly land the parts of the test carrier missile.

What is claimed is:

1. A separating arrangement between multipart constructional elements comprising:

an expansion chamber containing at least one pyrotechnic charge;

a displacement piston having a piston surface bounding said expansion chamber for separating said multipart constructional elements, said displacement piston being slideable along a first axis;

at least one gas passageway in communication with said expansion chamber; and a separating piston being supplied with pressure through said gas passageway for separating connecting elements extending between said multipart constructional elements, said separating piston being slideable along a second axis different from said first axis.

2. A separating arrangement as claimed in claim 1, wherein said separating piston is displaceably supported within the displacement piston.

3. A separating arrangement as claimed in claim 1, wherein the separating and displacement pistons, based upon their active piston surface relative to the expansion chamber, are latchable in position through the intermediary of differently dimensioned shear pins.

4. A separating arrangement as claimed in claim 3, wherein the shear pins latching the displacement piston concurrently form a shear connection between the mututally separable elements along their separating location.

5. A separating arrangement as claimed in claim 1, wherein a cutter is in operative connection with the separating piston, said cutter being guided transverse to the path of conduits extending across the separating location between said elements.

6. A separating arrangement as claimed in claim 5, wherein the conduits extend within a tube passing through a guide wall for the cutter.

7. A separating arrangement as claimed in claim 6, wherein the tube is broken through at the cutting location of said cutter.

8. A separating arrangement as claimed in claim 1, wherein the displacement piston is movably supported within one of the elements; and ram means supporting said piston against the other element.

9. A separating arrangement as claimed in claim 8, wherein the ram has a hollow funnel-shaped construction and bounds a recovery parachute storage space extending across the separating location.

10. A separating arrangement as claimed in claim 9, wherein the funnel-shaped ram is form-fittingly fastened to the element being detached through the displacement piston at the end of path of movement of the latter; an eyelet for connecting shroud lines of the parachutes being provided within said ram for the opening of the recovery parachutes which are to be withdrawn from the storage space subsequent to the opening of the separating location.

* * * * *